US007104471B1

(12) United States Patent
Behan et al.

(10) Patent No.: US 7,104,471 B1
(45) Date of Patent: Sep. 12, 2006

(54) DISPENSING DEVICES

(75) Inventors: John Martin Behan, Boughton Aluph (GB); Kishen Gohil, New Malden (GB); Gerry Hart, deceased, late of Surbiton (GB); by Susan Hart, legal representative, Surbiton (GB); Tony Lee, London (GB)

(73) Assignee: Quest International B.V., Naaarden (NL)

( * ) Notice: Subject to any disclaimer, the term of this patent is extended or adjusted under 35 U.S.C. 154(b) by 68 days.

(21) Appl. No.: 10/088,601

(22) PCT Filed: Sep. 25, 2000

(86) PCT No.: PCT/GB00/03672

§ 371 (c)(1),
(2), (4) Date: Aug. 29, 2003

(87) PCT Pub. No.: WO01/21322

PCT Pub. Date: Mar. 29, 2001

(30) Foreign Application Priority Data

Sep. 24, 1999 (EP) ..... 99307556

(51) Int. Cl.
*B05B 7/30* (2006.01)

(52) U.S. Cl. ..... 239/340; 239/311; 239/318; 239/349; 239/555

(58) Field of Classification Search ..... 239/295, 239/302, 310, 311, 314–316, 318, 346, 349, 239/340, 553–555
See application file for complete search history.

(56) References Cited

U.S. PATENT DOCUMENTS 3,696,973 A * 10/1972 Cottell ..... 239/154
3,744,722 A 7/1973 Burns
4,023,524 A * 5/1977 Goldfarb et al. ..... 118/301
4,047,995 A * 9/1977 Leal-Diaz ..... 156/203
4,222,525 A * 9/1980 Hildebrandt ..... 239/343
4,545,535 A 10/1985 Knapp
4,595,127 A * 6/1986 Stoody ..... 222/135
5,046,667 A * 9/1991 Fuhrig ..... 239/124
5,102,052 A * 4/1992 Demarest et al. ..... 239/355
5,181,349 A * 1/1993 Schaffer ..... 451/75
5,248,096 A * 9/1993 Hoey et al. ..... 239/272
5,346,135 A * 9/1994 Vincent ..... 239/306
5,480,095 A 1/1996 Stevenson et al.
5,520,339 A * 5/1996 Kuo ..... 239/542
5,743,468 A 4/1998 Laidler
5,765,758 A * 6/1998 Chu ..... 239/369
5,826,795 A * 10/1998 Holland et al. ..... 239/318
6,568,604 B1 * 5/2003 Behan et al. ..... 239/314

FOREIGN PATENT DOCUMENTS

EP 0 655 282 A1 5/1995
GB 525736 9/1940

(Continued)

*Primary Examiner*—David A. Scherbel
*Assistant Examiner*—Seth Barney
(74) *Attorney, Agent, or Firm*—Morgan Lewis & Bockius LLP

(57) ABSTRACT

A liquid dispensing device for dispensing a liquid into the surrounding atmosphere employs a forced airflow through a small cross-section outlet nozzle (48) to draw the liquid from an adjacent exit nozzle (50) into the airflow. The air outlet nozzle preferably has a cross-section less than that of the liquid exit nozzle. The liquid exit nozzle may partially overlie the airflow path from the air outlet nozzle. The nozzle may be formed in or carried by a unit (24) having sealed connections with the airflow source (16) and a container holding the liquid.

7 Claims, 3 Drawing Sheets

FOREIGN PATENT DOCUMENTS

| | | |
|---|---|---|
| GB | 535736 | 9/1940 |
| GB | 2 055 307 | 3/1981 |
| WO | WO 91/03270 | 3/1991 |
| WO | 99/49904 | 10/1999 |

* cited by examiner

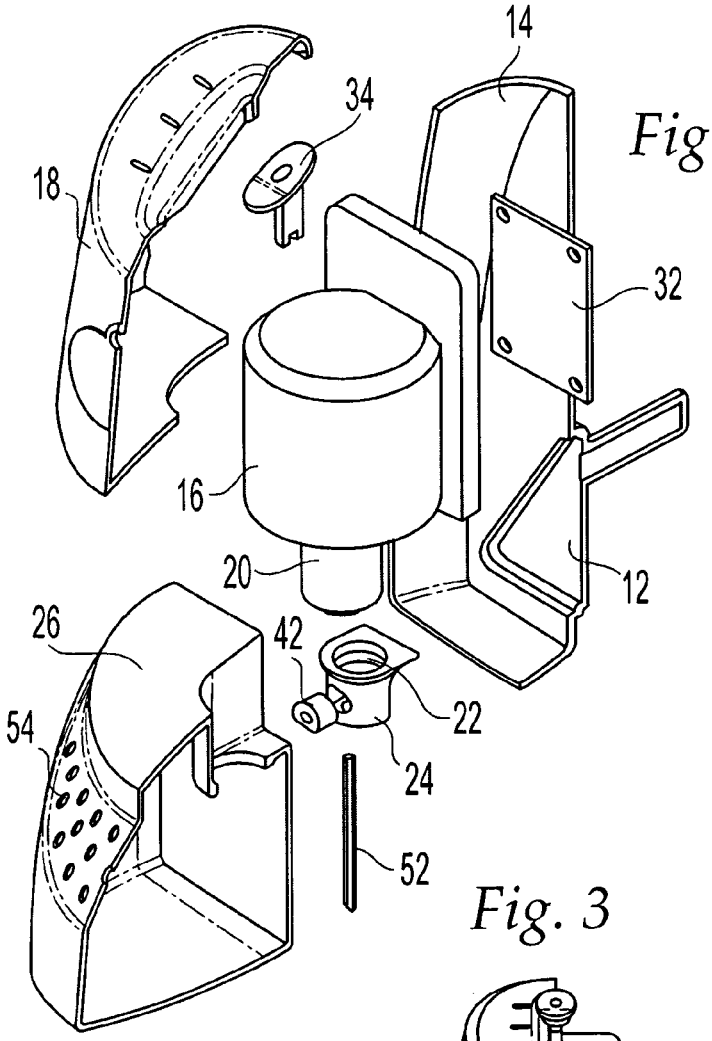
Fig. 2
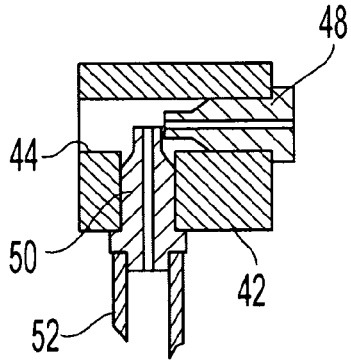
Fig. 4
Fig. 3
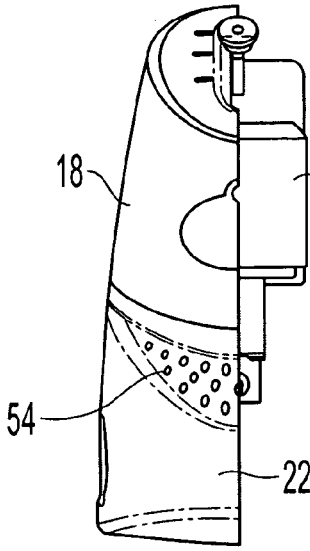
Fig. 1
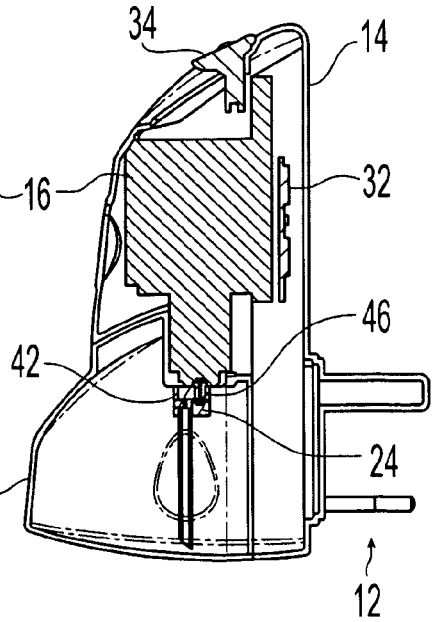

Fig. 7
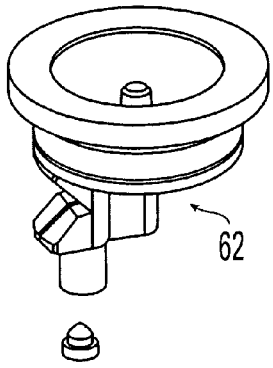
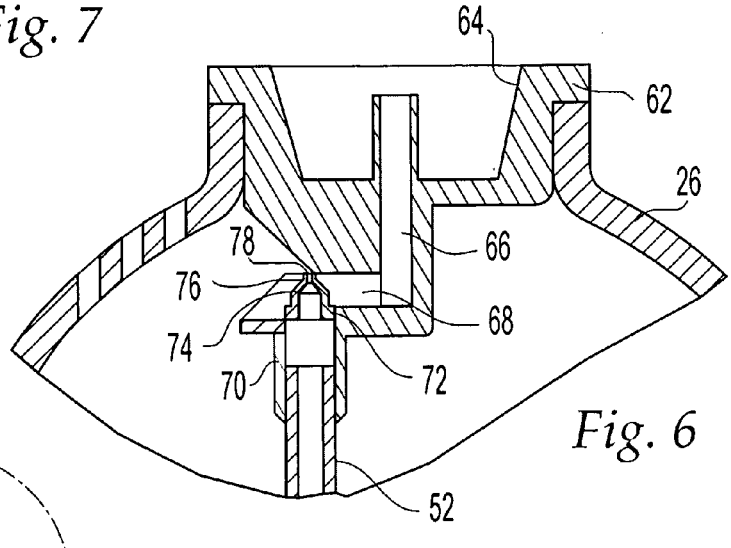
Fig. 6
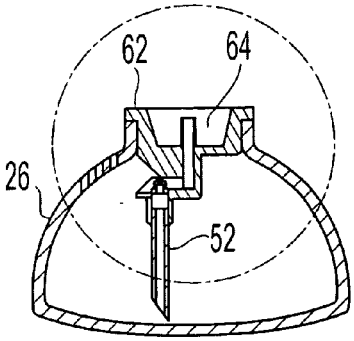
Fig. 5
Fig. 9
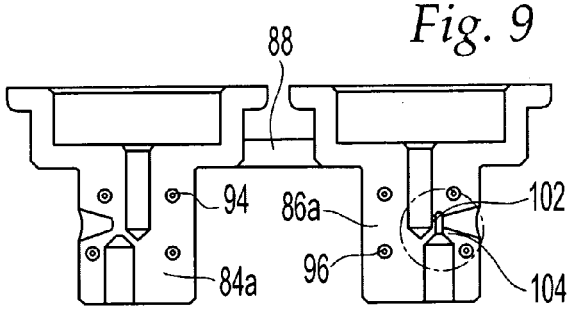
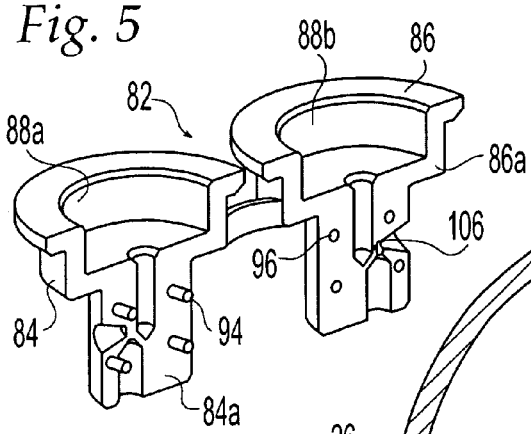
Fig. 10
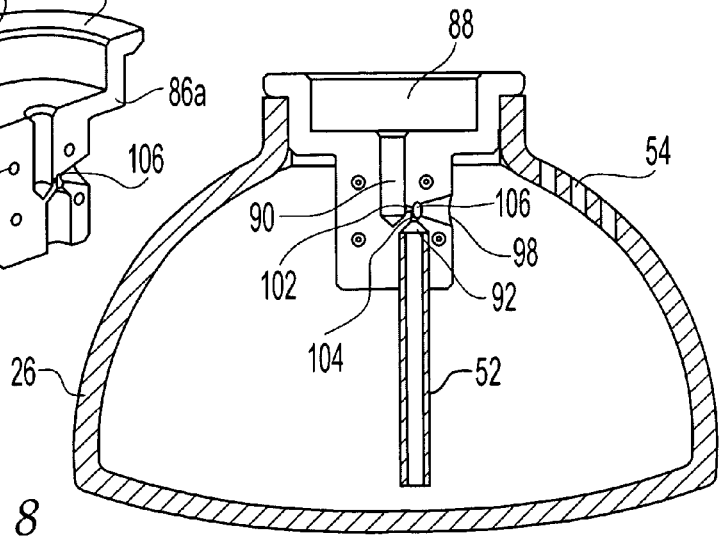
Fig. 8

DISPENSING DEVICES

FIELD OF THE INVENTION

This invention relates to devices for the dispensing of liquids into a carrier fluid.

BACKGROUND

Our patent application PCT/GB99/00998 describes apparatus for dispensing a volatile liquid into a surrounding atmosphere in which a driving airflow is used to draw the liquid from a conduit by producing a pressure drop in the region of an outlet from the conduit in the manner of a jet pump or venturi. The liquid conduit may be formed as a capillary tube and the airflow may be directed past the conduit outlet region through an air delivery nozzle having a similar size cross-section.

By the use of such devices with small cross-section nozzles, it is possible to achieve rapid dispersal of the liquid into the atmosphere using low mass air flows and to do this by means of a compact device with only a small power requirement. The present invention is concerned with further improvements of devices of this nature.

SUMMARY OF THE INVENTION

According to one aspect of the invention, there is provided a liquid dispensing device comprising an air pump, a vessel for the liquid to be dispensed, a syphon tube extending from a lower region of the vessel to an exit nozzle, an air outlet conduit for said pump provided with an outlet nozzle for directing a stream of pumped air past the liquid exit nozzle, the air outlet nozzle having an effective cross-sectional area not more than twice that of the liquid exit nozzle.

The liquid conduit is preferably a capillary tube with a cross-sectional area about 10 $mm^2$ or less. The liquid exit nozzle is no larger and can have a substantially smaller cross-section eg. equivalent to a diameter of approximately 1–2 mm.

The air outlet nozzle preferably has a cross-sectional area not substantially more than that of the liquid exit nozzle, or even up to about 40% less than the liquid exit nozzle. It is also possible to form the air outlet nozzle as an orifice of a size similar to or greater than the liquid exit nozzle but with a smaller effective cross-sectional area by virtue of a baffle or other obstacle to the issuing flow immediately downstream of the orifice. For example the liquid exit nozzle structure may project into and partly block the flow path from the orifice in the air flow path. This both reduces the effective cross-sectional area to increase the air flow velocity and generates unsteady flow conditions which will enhance the dispersal of the liquid drawn into the flow.

Thus, according to another aspect, the invention provides a liquid dispensing device comprising a vessel for the liquid to be dispensed, an outlet passage extending from a lower region of the vessel to a liquid exit nozzle, a conduit provided with an outlet nozzle for directing a stream of air past the liquid exit nozzle, the liquid exit nozzle extending into a projection of the air outlet nozzle axially thereof to partially overlie said projection, the portion of the nozzle projection not so overlain having a cross-sectional area not substantially greater than the cross-section of the liquid exit nozzle.

In the case in which the air outlet nozzle has an orifice substantially equal to or smaller than the liquid exit nozzle, a baffle or the like obstacle may be located downstream of the liquid exit nozzle to promote unsteady flow conditions for accelerating the dispersal of the liquid in the airflow.

It is desirable to ensure that the outlet opening of the liquid exit nozzle of a liquid dispensing device according to the invention, at its closest to the air outlet nozzle opening, is spaced not more that four times the mean cross-sectional dimension of the air outlet nozzle from that nozzle, in order to limit the degree of diffusion of the airstream before it flows across the liquid exit nozzle outlet, and preferably the spacing is not substantially more than twice that dimension.

The invention is also concerned with arrangements of liquid dispensing devices in a manner suitable for large scale production.

Thus, in one arrangement according to a further aspect of the invention, a liquid dispensing device is provided comprising a vessel for a liquid to be dispensed, a conduit extending upwardly from a lower region of the vessel to a liquid exit nozzle, and an air pump connected to an outlet conduit having an air outlet nozzle opening adjacent said liquid exit nozzle to draw liquid therefrom by a flow of air through said outlet nozzle, said air and liquid nozzles being formed by a pair of elements having opposed faces at which the elements are sealed together, said nozzles comprising depressions in at least one of said faces.

In an alternative arrangement, the liquid dispensing device comprises a vessel for a liquid to be dispensed, a conduit extending upwardly from a lower region of the vessel to a liquid exit nozzle, and an air pump connected to an outlet conduit having an air outlet nozzle opening adjacent said liquid exit nozzle, at least the liquid exit nozzle being defined by a separately formed insert. The air outlet nozzle may comprise a further insert and, to control their relative location, the inserts may be arranged to lie in contact with each other.

In accordance with yet another aspect of the invention, a liquid dispensing device is provided comprising a pump for generating a carrier fluid flow, a replaceable vessel removably connected to a mounting communicating with a fluid flow exit from said generating means, said vessel providing a container for the liquid to be dispensed, an outlet passage for said liquid extending between the mounting and a lower region of the vessel, said mounting of the device containing coacting nozzles for the flow from said generating means and the liquid from said outlet passage to entrain the liquid in suspension in said fluid flow.

BRIEF DESCRIPTION OF THE DRAWINGS

Examples of the invention will be described with reference to the accompanying drawings in which:

FIG. 1 is a cross-section in a central vertical plane of one form of device according to the invention, FIGS. 2 and 3 are, respectively, an oblique exploded view and a front view of the device of FIG. 1 with the portions of the main body mouldings to one side of the central vertical plane of symmetry omitted, FIG. 4 is a detail sectional view in the plane of FIG. 1 of the air and liquid outlet in the device of FIGS. 1–3, FIG. 5 is a detail sectional view illustrating an alternative arrangement of the liquid and air conduit outlets in the liquid container of another form of device according to the invention, FIG. 6 is a view to a larger scale of the circled region in FIG. 5, FIG. 7 is an exploded oblique illustration of the nozzle assembly of the device of FIGS. 5 and 6, FIG. 8 is a sectional view similar to FIG. 5 showing a further modified form of device according to the invention with half of the nozzle unit removed, FIGS. 9 and 10 are front and oblique views of a unitary moulding that provides the air and liquid outlet nozzles in the device of FIG. 8.

DESCRIPTION OF EMBODIMENTS

Figure 12:
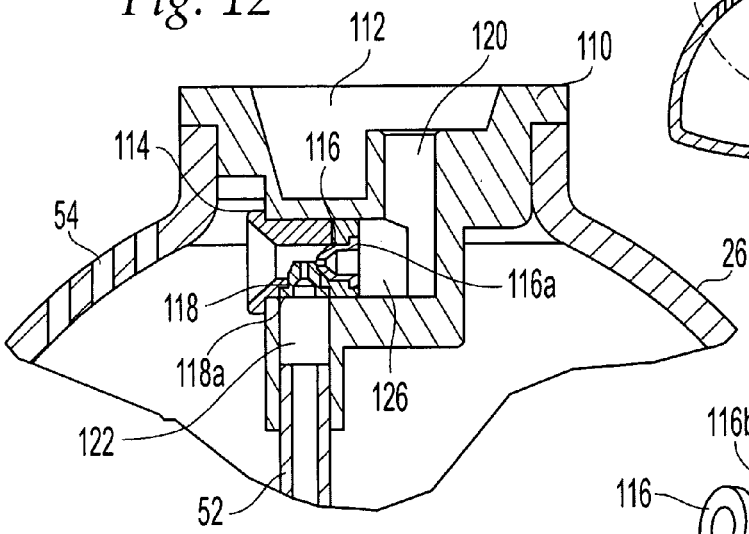
FIGS. 12 and 13 are, respectively, a larger scale view of the circled region in FIG. 11 and an exploded view from below of the air and liquid outlet nozzles in the device of FIGS. 11 and 12.

Referring to FIGS. 1 to 4, the dispensing device is in the form of a plug-in unit intended to be mounted on an electrical supply socket by a 3-pin connection plug 12 at the rear of the device. The device has a casing comprising a rear body moulding 14 from which the plug pins project. A pumping unit 16 comprising an electric motor and an air pump is mounted on the rear moulding and is enclosed by a front cover moulding 18 permanently secured to the rear moulding 14. At the bottom of the air pump is a centrically located spigot 20 on which a socket 22 of a nozzle unit 24 fits closely. The nozzle unit 24 projects into a container 26 which is detachably held in the unit casing by securing means (not shown) between it and the rear moulding 14.

The nozzle unit 24 in this and the later examples may form an integral part of the air pump spigot 20 or of the container 26 and comprise a mating part that seals releasably with the container or the pump spigot respectively. However, it may alternatively be a separate adaptor that, as shown in this example, fits as a sealing plug into the neck of the container 26 and, through the socket 22 in its top face, that similarly seals with the spigot.

Also mounted on the rear moulding is a printed circuit board 32 providing electrical connection between the plug connection 12 and the pump motor and comprising a variable time circuit which is controlled by a timer switch 34 slidably mounted on the front cover 18.

The nozzle unit 24 comprises a nozzle block 42 integral with the main body of the unit or formed as a plug-in member inserted into a side face of the unit, as illustrated in FIG. 2 in particular. The nozzle block 42 has a through bore 44 communicating with the air pump outlet through a vertical passage 46 in the nozzle unit. An air nozzle 48 is located in the entry end of the bore 44 and abuts a liquid nozzle 50 which projects into the bore from below. Secured to the lower end of the liquid nozzle 50 is a capillary tube 52 which extends downwards to the bottom of the container 26.

The capillary tube diameter may be about 3 mm. The bore of the liquid nozzle 50 is considerably smaller, eg. not substantially more than 1 mm diameter and possibly as small as 0.5 mm or less. The bore of the air nozzle 48 may be of a similar size, or possibly smaller than the liquid nozzle bore, eg. with about half the cross-sectional area of the liquid nozzle bore. In addition, the illustrated example shows effective size of the air nozzle exit further reduced because it is overlapped by the tip of the liquid nozzle.

In operation, the air pump produces an air jet from the air nozzle 48. The jet velocity is relatively high although the small size of the air nozzle means the volumetric flow is relatively small. A reduced pressure is thereby produced over the exit from the liquid nozzle 50 and liquid is drawn from the nozzle as fine droplets which, because of the high air velocity, are rapidly dispersed in the air flow.

To employ the high velocity, low volume airflow from the air outlet nozzle efficiently the liquid exit nozzle should be located close to the air nozzle because the airstream will diffuse rapidly as it flows away from the air nozzle. If this effect is not controlled, a much greater mass flow of air would be required to take up the liquid. In the example of FIG. 4, the air nozzle outlet is located some two diameters of the nozzle diameter from the liquid nozzle exit opening and the distance is preferably no more than twice that.

The overlap of the liquid nozzle 50 with the air nozzle 48 has a further effect in forming an impingement surface disturbing the flow exiting from the air nozzle. This effect promotes the mixing of liquid into the air flow and helps to inhibit the formation of large liquid droplets which would hinder rapid dispersal in the airflow.

The resulting flow of air with liquid vapour and droplets is dispersed into the surrounding atmosphere through exit openings 54 in the front wall of the container. The exit openings 54 are at an angle to the flow path from the nozzle unit bore 44 so the container front wall forms a further barrier for any larger liquid droplets in the flow. If such droplets strike the front wall they return into the main body of liquid in the container.

In the example of FIGS. 5 to 7 the dispensing device may be a plug-in unit with a casing and a pumping unit arranged in the same manner as in the preceding example. The drawings show a modified air-liquid mixing arrangement in which a nozzle unit 62 between the air pump outlet spigot 20 and the liquid container 26 has an integral air nozzle. As in the first example, the spigot 20 is received in a socket 64 in the unit 62, and a conduit 66 communicating with the air pump outlet leads downwards from the socket. At its lower end the conduit 66 joins a deep but narrow slit-like passage 68 in the unit 62 providing an air outlet nozzle.

At the bottom of the nozzle unit 62, into a tubular extension 70 opening into the narrow passage 68 is inserted the capillary liquid tube 52. Above the tube 52 and projecting into the passage 68 is a liquid outlet nozzle 72 with a diameter over most of its height greater than the width of the passage 68.

The liquid outlet nozzle has a conical cap 74 with a central outlet opening 76 of a similar diameter to the outlet nozzle of FIG. 4, eg. 0.5 mm to 1 mm. It will be noted that the air conduit 66, which may have a circular bore, is considerably larger and, although it opens into the smaller cross-section nozzle passage 68, the divergent rectangular cross-section of that passage is still considerably larger than the liquid nozzle outlet opening 76. However, the projection of the liquid outlet nozzle 72 into the air passage 68 reduces the free cross-section for the air flow substantially. Since the diameter of the base of the conical tip 74 is greater than the width of the passage 68, air can only flow past the liquid outlet nozzle close to the upper end of the conical tip. A nozzle throat is thus formed with an air flow cross-section which is preferably not substantially greater than the liquid outlet opening 76, and which in the illustrated example is smaller than that outlet opening.

Immediately downstream of the liquid nozzle the cross-section of the passage 68 increases sharply, so that there is a similarly sharp increase of static pressure which intensifies the mixing of the liquid drawn from the liquid outlet nozzle into the air flow. In the illustrated example, as is shown in FIG. 7, there is a step 78 in the passage wall at or adjacent the liquid nozzle outlet which promotes disturbance of the air flow and further increases the rate of mixing with the liquid drawn from the liquid nozzle.

The formation of flow passages of 1 mm diameter or less with the accuracy required to control the pressure changes at the point of mixing is difficult to achieve economically in large scale production. To some extent the use of nozzle inserts, as in the first-described example, and the control of their relative location by abutting the inserts against each other is able to reduce the extent to which precision manufacturing techniques are required. However, FIGS. 8–10 illustrate another way in which the cost of manufacture can be substantially reduced.

In this example, again, only the container 26 and a nozzle unit 82 are shown and the remainder of the device may take the same form as in the first example. The air and liquid nozzles are integral parts of the nozzle unit 82 between the air pump spigot 20 and the liquid container 26. The unit 82 itself is a unitary plastics moulding having two opposed parts 84,86 joined by an integral hinge element 88 about which the two parts can be folded together to bring their opposed planar faces 84*a*,86*a* together, these mating faces being sealed together at their areas of contact. The socket 88 receiving the air pump spigot is formed as two semicircular recesses 88*a*,88*b* in the two parts 84,86 and conduits 90,92 respectively for the air and liquid flows to the nozzles are also divided to be formed by semi-circular grooves in the faces 84*a*,86*a*. In the abutting faces 84*a*,86*a* dowelling projections 94 are formed in the one part 84 for engagement with depressions 96 in the other part 86 to locate the matching recesses in the two parts together accurately.

The two parts of the moulding also share between them corresponding recesses forming a divergent exit passage 98 for the mixed flow of air and liquid droplets. However, the air and liquid nozzles between the conduits 90, 92 and the exit passage 98 are formed as recesses 102, 104 respectively in only one of the parts because of their small cross-sectional size. Thus from one of the recesses forming the air supply conduit 90 the air nozzle 102 extends to intersect the liquid exit nozzle 104 which has a similar or somewhat larger cross-section and which extends from one of the recesses forming the liquid supply conduit 92. At the downstream side of the liquid outlet nozzle 104 is a baffle 106 which reduces the outlet cross-section abruptly at the beginning of the divergent exit passage 98 to promote mixing in a similar manner to the preceding examples. This baffle adjacent the nozzle exits disturbs the mixed flow of air and liquid from the nozzles.

The manufacture of a unitary moulding of the kind shown in FIGS. 8–10 can be further simplified by forming further features, such as the conduits 90,92 and the exit passage 98, in a face of one of the parts, the other part then having a mainly or wholly planar mating face.

Figure 11:
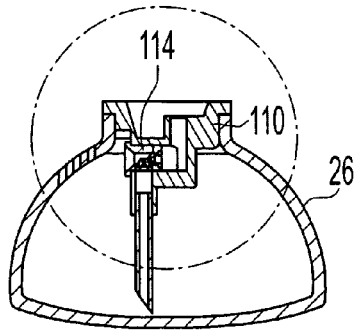
FIG. 11 is a sectional view similar to FIG. 5 illustrating a yet further modified form of device according to the invention.
Figure 13:
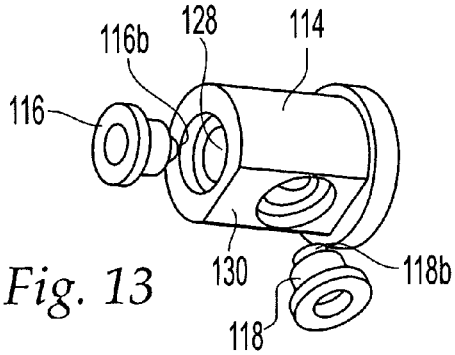

FIGS. 11–13 show a further modified form of nozzle unit 110 devised with a view to simplifying manufacture of the dispensing device. Only part of the device is illustrated and the remainder of the device may be as shown in FIGS. 1–4. The nozzle unit 110 has a socket 112 receiving the air pump spigot 20 and it fits sealingly on the neck of the container 26 as in the earlier examples, but in this case the unit 110 carries a plug insert 114 into which respective air and liquid nozzles 116,118 are in their turn fitted. The nozzle unit has upper and lower entry conduits 120,122 for the air and liquid flows respectively, the liquid capillary tube 52 being inserted into the lower conduit 122. Both conduits lead to a cross-passage 126 in which the plug insert 114 is a sealing fit.

The plug insert 114 has a through-bore 128 coaxial with the cross-passage 126 in the nozzle unit 110. A flat 130 on the insert 114 locates against a corresponding flat in the passage 126 to ensure that the plug insert is held in the nozzle unit with the liquid nozzle 118 aligned with the liquid entry conduit 122. Both nozzles 116,118 are rotationally symmetrical and can be produced with a high accuracy using simple dies. The plug insert 114 is similarly able to be produced economically with high dimensional accuracy, but it is only necessary to control the dimensions of the main body of the adaptor to ensure it makes fluid-tight seals with the parts to which it is attached.

Each nozzle has a locating flange 116*a*,118*a* that sets the depth of insertion into the plug insert 114. When fully entered, as shown in the FIG. 12 conical end face 116*b* of the air nozzle abuts the end face 118*b* of the liquid nozzle. The liquid nozzle outlet has a diameter of 0.5 mm and the air nozzle outlet diameter is smaller at 0.3 mm, but in addition the air nozzle outlet is partly blocked by the overlapping tip of the liquid nozzle, analogously to the first-described example. The effective exit flow area is thus reduced and, moreover, the facing side wall of the liquid nozzle forms a baffle that promotes unsteadiness in the exiting air flow.

The invention claimed is:

1. A liquid dispensing device comprising an air pump, a vessel having a lower region, for the liquid to be dispensed, a conduit extending upwardly from the lower region of the vessel to a liquid exit nozzle, an outlet conduit for air flow from said pump, an air outlet nozzle adjacent the end of said outlet conduit, said air outlet nozzle being positioned adjacent said liquid exit nozzle such that air discharged from the air outlet nozzle flows past said liquid exit nozzle and draws liquid therefrom in vapor and/or droplet form into said flow, the air outlet nozzle having a cross-section less than that of the liquid exit nozzle wherein said air outlet nozzle and said liquid exit nozzle comprise a nozzle unit which includes a pair of elements having opposed faces at which the elements are sealed together, at least one of said faces having depressions formed therein such that when said elements are sealed together said depressions define said nozzles.

2. A liquid dispensing device comprising an air pump, a vessel for the liquid to be dispensed, a conduit extending from a lower region of the vessel to a liquid exit nozzle, an outlet conduit for an air flow from said pump leading to an air outlet nozzle for directing the air flow past the liquid exit nozzle to draw liquid in vapor and/or droplet form into said flow, the air outlet nozzle having a cross-section less than that of the liquid exit nozzle and the air outlet nozzle and liquid exit nozzle being substantially perpendicular to one another wherein said air outlet nozzle and said liquid exit nozzle comprise a nozzle unit which includes a pair of elements having opposed faces at which the elements are sealed together, at least one of said faces having depressions formed therein such that when said elements are sealed together said depressions define said nozzles.

3. A liquid dispensing device comprising a nozzle unit having formed therein a liquid exit nozzle and an air outlet nozzle opening adjacent said liquid exit nozzle, a vessel for a liquid to be dispensed and a conduit extending from a lower region of said vessel to said liquid exit nozzle, said air outlet nozzle being for a forced air flow to draw liquid from said liquid exit nozzle into said airflow, said nozzle unit comprising a pair of elements having opposed faces at which the elements are sealed together, at least one of said faces having depressions formed therein, such that when said elements are sealed together said depressions define said nozzles.

4. A device according to claim 3 including further depressions in at least one of said faces which define, when said elements are seated together, sockets for receiving air and liquid supply means, and means for connecting said supply means to said nozzles.

5. A device according to claim 3 wherein said sealed together elements comprise a baffle adjacent the nozzle exits for disturbing the mixed flow of air and liquid from said nozzles.

6. A device according to claim 3 wherein at least one of said faces has an additional depression defining a divergent passage extending downstream from said air and liquid nozzles for a mixed flow of liquid and air from said nozzles.

7. A device according to claim 3 wherein at least one of said nozzles is defined by a depression in one said element and a planar face of the other said element.

* * * * *

UNITED STATES PATENT AND TRADEMARK OFFICE

CERTIFICATE OF CORRECTION

PATENT NO. : 7,104,471 B1
APPLICATION NO. : 10/088601
DATED : May 2, 2006
INVENTOR(S) : John Martin Behan et al.

It is certified that error appears in the above-identified patent and that said Letters Patent is hereby corrected as shown below:

On the title page, first inventor, "John Behan Martin" should read as --John Martin Behan--;

Signed and Sealed this

Thirty-first Day of October, 2006

JON W. DUDAS
*Director of the United States Patent and Trademark Office*

UNITED STATES PATENT AND TRADEMARK OFFICE

CERTIFICATE OF CORRECTION

PATENT NO. : 7,104,471 B1
APPLICATION NO. : 10/088601
DATED : September 12, 2006
INVENTOR(S) : John Martin Behan et al.

It is certified that error appears in the above-identified patent and that said Letters Patent is hereby corrected as shown below:

On the title page, first inventor, "John Behan Martin" should read as --John Martin Behan--;

This certificate supersedes Certificate of Correction issued October 31, 2006.

Signed and Sealed this

Nineteenth Day of December, 2006

JON W. DUDAS
*Director of the United States Patent and Trademark Office*